US007398900B2

(12) United States Patent
Friedman

(10) Patent No.: US 7,398,900 B2
(45) Date of Patent: Jul. 15, 2008

(54) DISPENSING CLOSURE, PACKAGE AND METHOD OF MANUFACTURE

(75) Inventor: Alberto Friedman, Dacula, GA (US)

(73) Assignee: Owens-Illinois Closure Inc., Perrysburg, OH (US)

( * ) Notice: Subject to any disclaimer, the term of this patent is extended or adjusted under 35 U.S.C. 154(b) by 131 days.

(21) Appl. No.: 11/046,382

(22) Filed: Jan. 28, 2005

(65) Prior Publication Data

US 2006/0169723 A1 Aug. 3, 2006

(51) Int. Cl.
*B65D 5/72* (2006.01)

(52) U.S. Cl. ..... 222/494; 222/556

(58) Field of Classification Search ..... 222/494, 222/490–497, 541.1, 541.2, 541.3, 519, 522, 222/521, 556, 557; 215/306, 294, 232; 220/259.1
See application file for complete search history.

(56) References Cited

U.S. PATENT DOCUMENTS

| | | | | |
|---|---|---|---|---|
| 4,358,032 | A | 11/1982 | Libit | |
| 4,377,247 | A | 3/1983 | Hazard et al. | |
| 4,793,501 | A | 12/1988 | Beck | |
| D306,701 | S | 3/1990 | Beck | |
| 5,007,555 | A | 4/1991 | Beck | |
| 5,033,655 | A | 7/1991 | Brown | |
| 5,078,296 | A | 1/1992 | Amidzich | |
| 5,271,531 | A * | 12/1993 | Rohr et al. | 222/212 |
| 5,531,363 | A | 7/1996 | Gross et al. | |
| D374,399 | S | 10/1996 | Neveras et al. | |
| 5,632,420 | A | 5/1997 | Lohrman et al. | |
| 5,676,289 | A | 10/1997 | Gross et al. | |
| 5,788,108 | A * | 8/1998 | Rohr | 220/812 |
| 5,897,033 | A | 4/1999 | Okawa et al. | |
| 5,904,275 | A * | 5/1999 | Suffa | 222/494 |
| 5,938,086 | A | 8/1999 | Gross | |

(Continued)

FOREIGN PATENT DOCUMENTS

| | | |
|---|---|---|
| EP | 044 570 A1 | 1/1982 |

(Continued)

OTHER PUBLICATIONS

U.S. Appl. No. 10/252,917, filed Sep. 23, 2003 Inventor: Maurice R. Gnepper Title: Dispensing Closure, Package and Method of Manufacturing.

*Primary Examiner*—Lien M. Ngo

(57) ABSTRACT

A fluid dispensing closure includes a closure base having a deck, a skirt for securement to a container finish and a recess in the deck. The recess includes a first annular wall extending from the deck within the skirt, a second annular wall extending radially inwardly from the first annular wall at a position spaced from the deck, and a third annular wall extending toward the deck from an inner periphery of the second annular wall. A dispensing valve of flexible resilient elastomeric construction has a peripheral portion captured in compression between a collar and the third annular wall, and a concave central portion with at least one dispensing slit. In the preferred embodiment, the collar includes a flat annular deck, and a first annular wall extending from an outer periphery of the flat annular deck and engaging the third annular wall on the base to secure the collar and the valve to the base such that the outer surface of the annular deck of the collar is flush with the outer surface of the deck of the closure base.

10 Claims, 4 Drawing Sheets

U.S. PATENT DOCUMENTS

| | | | | |
|---|---|---|---|---|
| 5,971,232 | A | 10/1999 | Rohr et al. | |
| 6,039,224 | A | 3/2000 | Dallas, Jr. et al. | |
| 6,045,004 | A | 4/2000 | Elliott | |
| 6,089,419 | A * | 7/2000 | Gross | 222/494 |
| D440,494 | S | 4/2001 | Sagel et al. | |
| 6,454,130 | B1 | 9/2002 | Miller et al. | |
| 6,672,487 | B1 | 1/2004 | Lohrman | |
| 2003/0136783 | A1 * | 7/2003 | Hatsumoto et al. | 220/254.3 |
| 2005/0269373 | A1 * | 12/2005 | Gaiser et al. | 222/494 |

FOREIGN PATENT DOCUMENTS

| | | | |
|---|---|---|---|
| EP | 0544 381 | A2 | 6/1993 |
| JP | 11-240551 | | 9/1999 |
| WO | WO 03/091124 | A2 | 11/2003 |

* cited by examiner

DISPENSING CLOSURE, PACKAGE AND METHOD OF MANUFACTURE

The present invention is directed to dispensing closures for fluid products such as food condiments and body lotions, to dispensing packages that include such closures, and to methods of making such closures.

BACKGROUND AND SUMMARY OF THE INVENTION

U.S. Pat. No. 6,672,487 discloses a dispensing package for fluid products that includes a container having a body for holding a product to be dispensed and a finish with an open mouth. A closure base includes a skirt externally secured to the container finish and a wall coaxial with the container mouth. A collar has a deck with a central opening aligned with the mouth and a wall secured to the wall on the closure base. A dispensing valve of flexible resilient elastomeric construction has a peripheral portion captured between the collar deck and the base wall for securing the valve in position and simultaneously functioning as a seal between the base and the collar. A lid is integrally hinged to the collar or to the base.

Although the dispensing closure and package disclosed in the noted patent address problems theretofore extant in the art, further improvements remain desirable. In particular, it is desirable to provide a fluid dispensing closure of the subject type in which the dispensing valve and the valve retention collar are disposed within the closure base so as to provide a low profile appearance, inhibit removal of the collar and the valve and/or facilitate cleaning of the closure deck. A general object of the present invention is to provide a fluid dispensing closure, a dispensing package and a method of making a fluid dispensing closure that address one or more of these objectives.

A fluid dispensing closure in accordance with one aspect of the present invention includes a closure base having a deck, a skirt for securement to a container finish and a recess in the deck. The recess includes a first annular wall extending from the deck within the skirt, a second annular wall extending radially inwardly from the first annular wall at a position spaced from the deck, and a third annular wall extending toward the deck from an inner periphery of the second annular wall. A dispensing valve of flexible resilient elastomeric construction has a peripheral portion captured in compression between a collar and the third annular wall, and a central portion with at least one dispensing slit. In the preferred embodiment of the invention, the collar includes a flat annular deck, and a first annular wall extending from an outer periphery of the flat annular wall and engaging the third annular wall on the base to secure the collar and the valve to the base such that the outer surface of the annular deck of the collar is flush with the outer surface of the deck of the closure base. In the most preferred embodiment of the invention, these outer surfaces are in a plane that is at an acute angle to the axis of the closure base skirt so that any moisture that may collect on the outer surfaces tends to drain from the surfaces. Other aspects of the invention contemplate a fluid dispensing package that includes such a closure, and a method of making such a fluid dispensing closure.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

Figure 2:
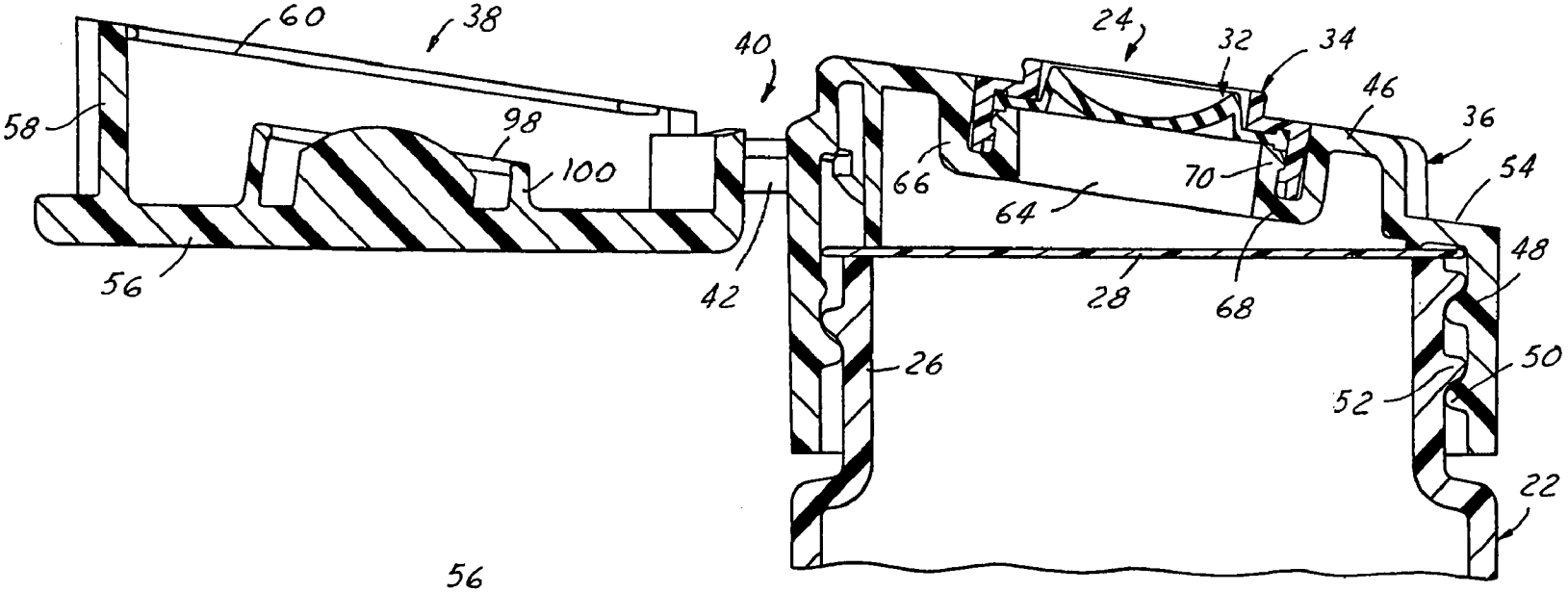
FIG. 2 is a fragmentary sectional view of the package illustrated in FIG. 1 but with the closure lid in the open position.
Figure 1:
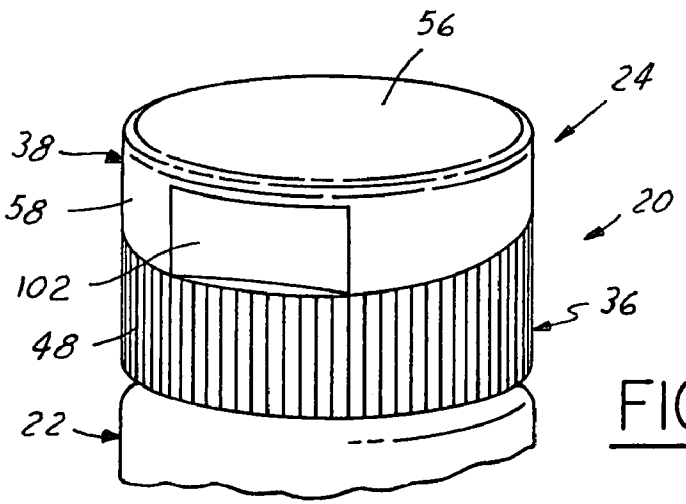
FIG. 1 is a fragmentary perspective view of a fluid dispensing package in accordance with one presently preferred embodiment of the invention.
Figure 3:
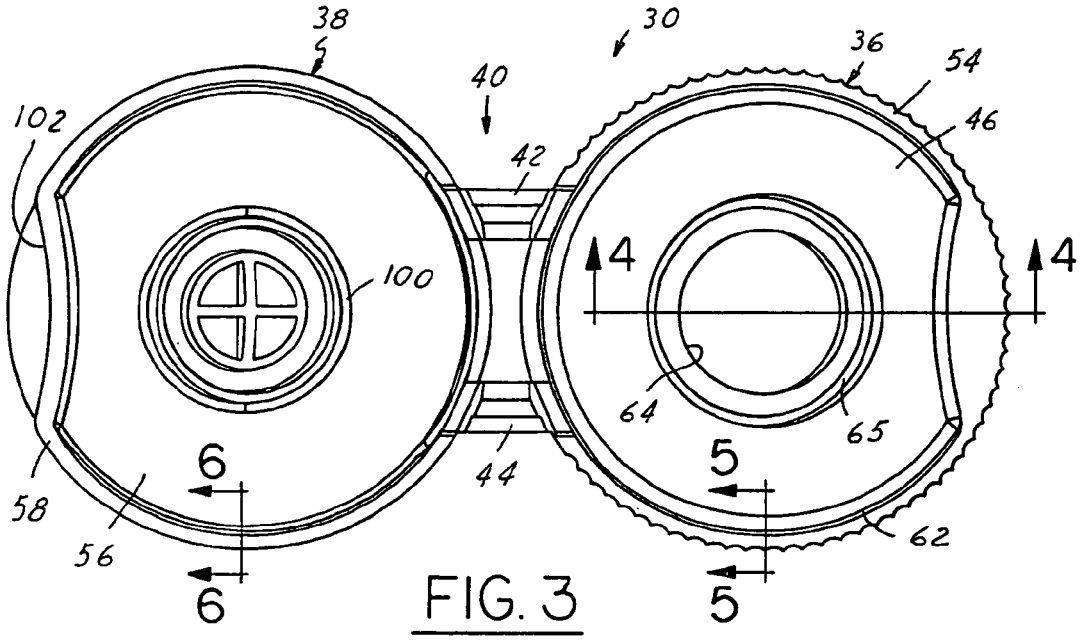
FIG. 3 is a top plan view of the closure shell in the package of FIGS. 1 and 2.

FIGS. 1 and 2 illustrate a fluid dispensing package 20 in accordance with one presently preferred embodiment of the invention as including a container 22 and a fluid dispensing closure 24. Container 22 includes a body for holding product to be dispensed and from which a cylindrical neck finish 26 extends. The container body may be of any suitable geometry. A sealing disk 28 is captured between closure 24 and the end surface of container neck finish 26. Seal disk 28 may be of any suitable construction, such as a multilayer disk that is heat-sealed to the upper surface of the container finish and which must be removed to dispense product from the container.

Dispensing closure 24 in the illustrated preferred embodiment of the invention is a three-piece assembly that includes a shell 30 (FIG. 3) to which a flexible resilient dispensing valve 32 is secured by a retaining ring or collar 34. Shell 30, which preferably is a one-piece integrally molded plastic construction as shown in FIGS. 2-7, includes a base 36 to which a lid 38 is pivotally secured by a hinge 40. Hinge 40 in the preferred embodiment of the invention comprises a pair of laterally spaced hinge elements 42,44 (FIG. 3) that together form a snap hinge of the type disclosed in U.S. Pat. No. 6,041,477. However, the invention is by no means limited to hinges of this type, and any other suitable hinge arrangement can be employed.

Figure 4:
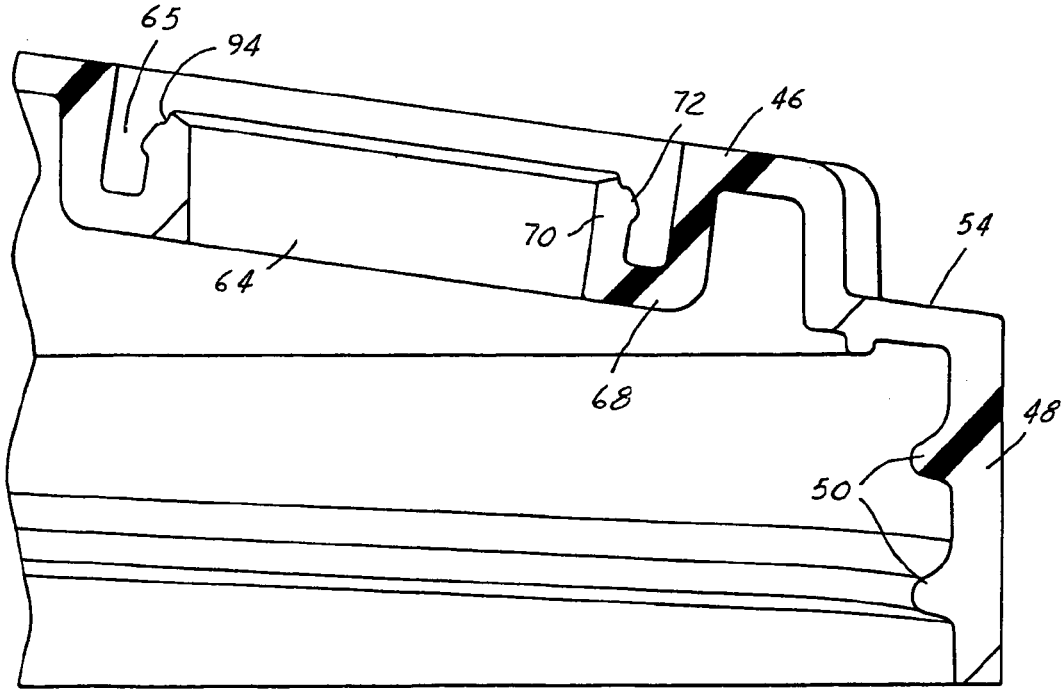
FIGS. 4, 5 and 6 are sectional views taken substantially along the respective lines 4-4, 5-5 and 6-6 in FIG. 3.
Figure 5:
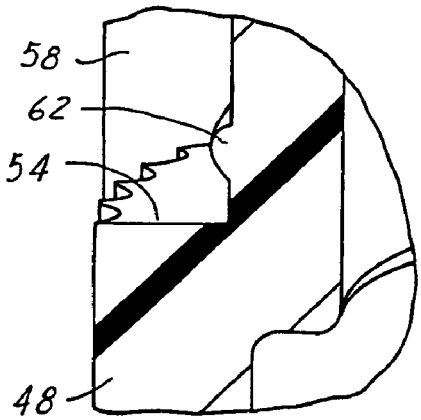
Figure 6:
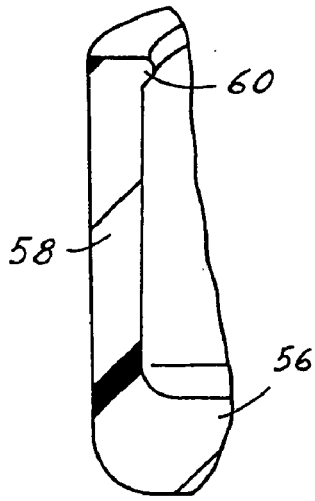
Figure 7:
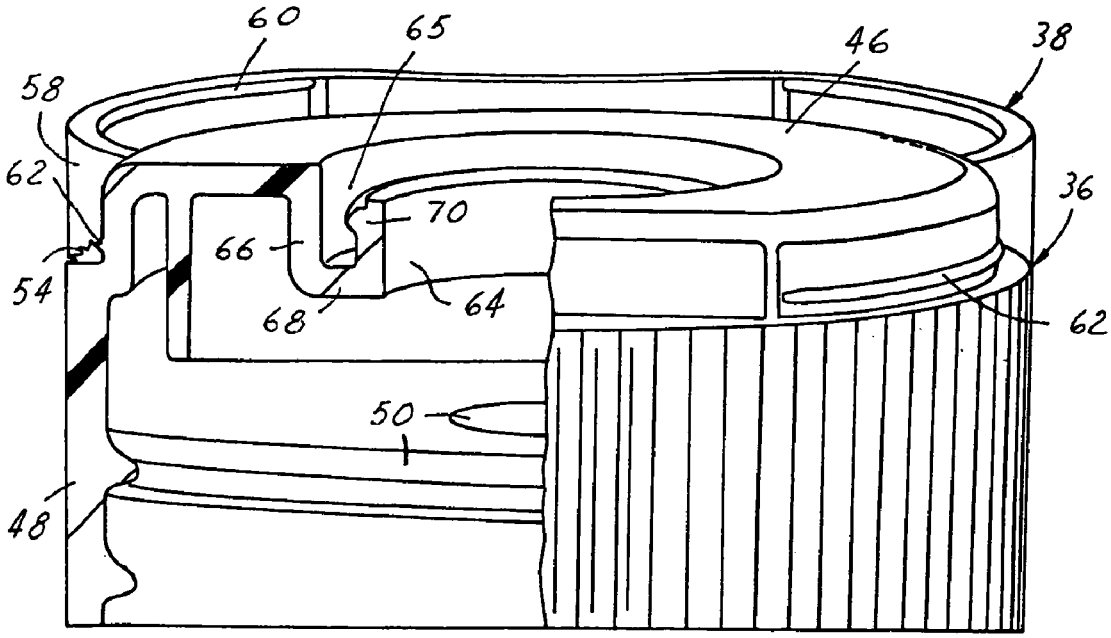
FIG. 7 is a partially sectioned side elevational view of the closure shell in FIG. 3.

Base 36 includes a deck 46 from which a skirt 48 integrally depends. Skirt 48 has suitable internal means, such as threads or beads, for securing closure 24 to neck finish 26 of container 22. In the illustrated embodiment of the invention, skirt 48 has one or more internal threads or thread segments 50 that cooperate with one or more external threads or thread segments 52 (FIG. 2) on container finish 26 for securing the closure to the container. As best seen in FIGS. 2, 4 and 7, deck 46 preferably is of planar or substantially planar construction and disposed at an angle to the central axis of closure skirt 48. A peripheral shoulder 54 surrounds deck 46 and is recessed with respect to deck 46, preferably being disposed at an angle parallel to the plane of deck 46. Lid 38 has a generally flat base wall 56 from which a peripheral skirt 58 extends. Skirt 58 has a free edge that preferably is disposed at an angle to the axis of base wall 56 so that base wall 56 is perpendicular to the axis of skirt 48 in the closed position of the lid (FIG. 1). In the preferred embodiment of the invention, a bead 60 is disposed around at least a portion of the interior of skirt 58 and cooperates with a bead 62 (FIGS. 3, 5 and 7) on base 36 for holding lid 38 in the closed position.

Base 36 has an opening 64 in deck 46. Opening 64 is surrounded by an annular recess 65 (FIGS. 4 and 7) that is defined in part by a first annular wall 66 that extends downwardly from deck 46. (Directional words such as "upwardly" and "downwardly" are employed by way of description and not limitation with respect to the upright orientation of the package and closure illustrated in FIGS. 1 and 2. Directional words such as "radially" and "axially" are employed by way of description and not limitation with respect to the axis of container finish 26 or closure skirt 48 as appropriate.) A second annular wall 68 extends radially inwardly from the lower edge of wall 66 spaced from deck 46, and preferably is flat and parallel to deck 46, or at least parallel to the periphery of deck 46 if deck 46 is non-planar. A third annular wall 70 extends upwardly from the inner periphery of annular wall 68. First annular wall 66 preferably is cylindrical, having an axis perpendicular to the plane of deck 46. Third annular wall 70 preferably is substantially cylindrical, having a central axis coaxial with the central axis of wall 66. The inner periphery of wall 70 can be non-cylindrical (FIG. 4) to facilitate removal of shell 24 from its forming mold. An external bead 72 extends around wall 70 adjacent to the free end of the wall and spaced from wall 68. Bead 72 may be circumferentially continuous or circumferentially segmented.

Figure 8:
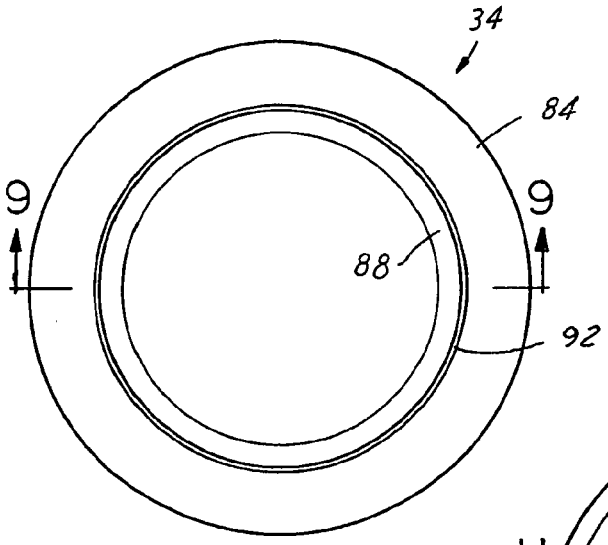
FIG. 8 a top plan view of the valve securement collar in the closure of FIG. 2.
Figure 10:
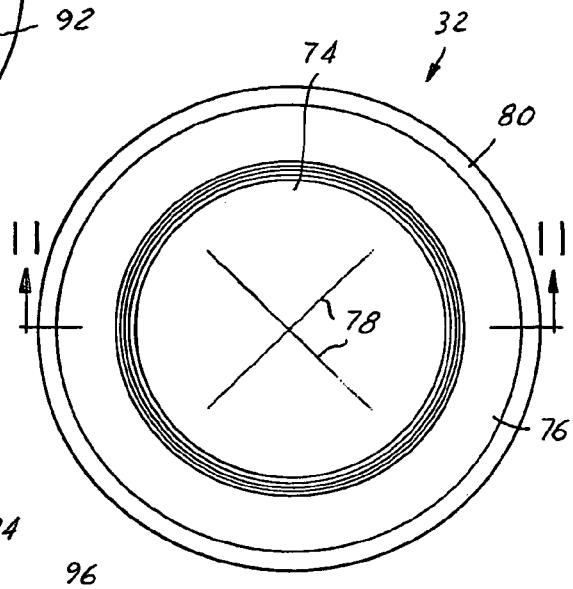
FIG. 10 is a top plan view of the dispensing valve in the closure of FIG. 2.
Figure 9:
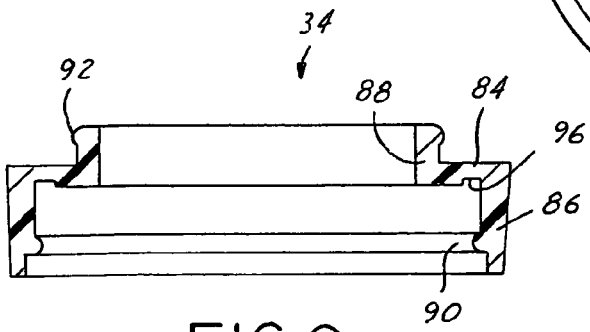
FIG. 9 is a sectional view taken substantially along the line 9-9 in FIG. 8.
Figure 11:
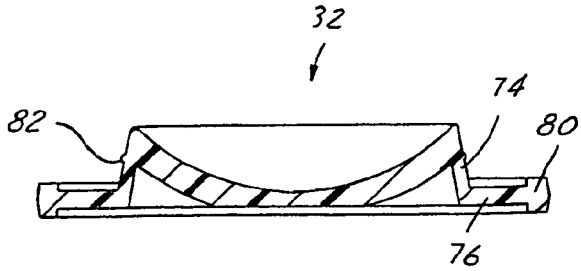
FIG. 11 is a sectional view taken substantially along the line 11-11 in FIG. 10.

Dispensing valve 32 is shown in detail in FIGS. 10 and 11. Valve 32 includes a central portion 74 and an annular peripheral flange or ledge 76. Central portion 74 preferably is conical, and preferably is angled radially inwardly from the inner periphery of ledge 76. One or more dispensing slits 78 (FIG. 10) are provided in central portion 74. An annular bead 80 extends around the outer periphery of ledge 76. A circumferential external bead 82 extends around central portion 74 adjacent to ledge 76, for purposes to be described. Retaining ring or collar 34 is illustrated in detail in FIGS. 8 and 9. Collar 34 includes a flat annular deck 84. A first wall 86 extends from the outer peripheral edge of deck 84, and a second wall 88 extends from the inner peripheral edge of annular deck 84 in a direction opposite from wall 86. Walls 84, 86 are substantially cylindrical, although the outer surface of wall 86, for example, can taper slightly to facilitate removal from its forming mold. An internal bead 90 extends around wall 86 at a position spaced from deck 84, and an external bead 92 extends around wall 88 at a position spaced from deck 84. Beads 90, 92 may be circumferentially segmented or continuous.

In assembly of valve 32 and collar 34 to base 36, valve 32 is positioned within collar 34, with valve bead 82 frictionally engaging the inside surface of collar wall 88 temporarily to hold the valve in position. Valve bead 80 is received within a circumferential channel 96 on the undersurface of deck 84 adjacent to wall 86. The collar is then secured over wall 70 on base 36, with bead 90 on collar 34 being received by snap fit over bead 72 on wall 70. Bead 80 on valve 32 is received within the channel 94 (FIG. 4) formed between bead 72 and the upper edge of wall 70. At this point, valve 32 is firmly secured to base 30. The upper or outer surface of collar deck 84 preferably is flush (coplanar in the preferred embodiment in which deck 84 is planar) with the upper or outer surface of base deck 46 to provide a trim and uniform low-profile look to the dispensing closure. Wall 88 of collar 34 extends upwardly from the surface of deck 46 both to protect dispensing valve 32, and for snap-receipt of an internal bead 98 on a wall 100 extending from the underside of lid base wall 56 to hold the lid in the closed position over deck 46. A thumb recess 102 is provided in skirt 58 of lid 38 opposite hinge 40 for facilitating separation of lid 38 from deck 36 to open the closure.

Closure shell 30 and collar 34 may be of suitable plastic construction such as polypropylene. Valve 32 may be of suitable flexible resilient construction such as liquid silicone rubber.

There have thus been disclosed a fluid dispensing closure, a fluid dispensing package and a method of making a fluid dispensing closure that fully satisfy all of the objects and aims previously set forth. The invention has been disclosed in conjunction with one presently preferred embodiment thereof, and a number of modifications and variations have been discussed. Other modifications and variations will readily suggest themselves to persons of ordinary skill in the art in view of the foregoing discussion. For example, the currently preferred closure illustrated in the drawings is a single-skirt closure construction, in which skirt 48 is a peripheral cylindrical skirt that serves to secure the closure to the container finish. An alternative construction would be a dual-skirt construction, in which a cylindrical inner skirt secures the closure to the container and an outer skirt has a geometry (e.g., cylindrical or oval) to blend with the adjacent geometry of the container. Deck 46 can be non-planar, such as a domed construction. The invention is intended to embrace these and all other modifications and variations as fall within the spirit and broad scope of the appended claims.

The invention claimed is:

1. A dispensing closure for fluid products, which includes:

a closure base having a deck, a skirt for securement to a container finish, and a recess in said deck including a first annular wall extending from said deck within said skirt, a second annular wall extending radially inwardly from said first annular wall at a position spaced from said deck, a third annular wall extending toward said deck from an inner periphery of said second annular wall, and a lid integrally hinged to said base to pivot between a closed position overlying said deck and an open position spaced from said deck, a collar secured to a free end of said third annular wall, and a dispensing valve of flexible resilient elastomeric construction having a peripheral portion captured in compression between said collar and said third annular wall, and a central portion with at least one dispensing slit, said collar including a flat annular deck, a first annular wall extending from an outer periphery of said flat annular deck and engaging said third annular wall on said base to secure said collar and said valve to said base, said collar including a second annular wall extending from an inner periphery of said flat annular deck, and said lid includes a wall for engaging said second annular wall on said collar to hold said lid in said closed position.

2. The closure set forth in claim 1 wherein an outer surface of said annular deck of said collar is flush with an outer surface of said deck of said closure base.

3. The closure set forth in claim 1 wherein said first annular wall on said collar and said third annular wall on said base have interlocking snap beads to secure said collar and said valve to said base.

4. The closure set forth in claim 1 wherein said second annular wall on said collar and said wall on said lid include snap beads for holding said lid in said closed position.

5. The closure set forth in claim 2 wherein said outer surfaces are in a plane that is at an angle to an axis of said skirt.

6. A fluid dispensing package that includes a container having a finish and a dispensing closure secured to said finish, said closure including:

a closure base having a deck, a skirt for securement to a container finish, and a recess in said deck including a first annular wall extending from said deck within said skirt, a second annular wall extending radially inwardly from said first annular wall at a position spaced from said deck, a third annular wall extending toward said deck from an inner periphery of said second annular wall, and a lid integrally hinged to said base to pivot between a closed position overlying said deck and an open position spaced from said deck, a collar secured to a free end of said third annular wall, and a dispensing valve of flexible resilient elastomeric construction having a peripheral portion captured in compression between said collar and said third annular wall, and a central portion with at least one dispensing slit, said collar including a flat annular deck, a first annular wall extending from an outer periphery of said flat annular deck and engaging said third annular wall on said base to secure said collar and said valve to said base, said collar including a second annular wall extending from an inner periphery of said flat annular deck, and said lid includes a wall for engaging said second annular wall on said collar to hold said lid in said closed position.

7. The package set forth in claim 6 wherein an outer surface of said annular deck of said collar is flush with an outer surface of said deck of said closure base.

8. The package set forth in claim 6 wherein said first annular wall on said collar and said third annular wall on said base have interlocking snap beads to secure said collar and said valve to said base.

9. The package set forth in claim 6 wherein said second annular wall on said collar and said wall on said lid include snap beads for holding said lid in said closed position.

10. The package set forth in claim 7 wherein said outer surfaces are in a plane that is at an angle to an axis of said skirt.

* * * * *